United States Patent [19]

Sudnishnikov et al.

[11] 4,209,070

[45] Jun. 24, 1980

[54] AIR-OPERATED SELF-PROPELLING ROTARY-PERCUSSIVE DOWNHOLE DRILL

[76] Inventors: Boris V. Sudnishnikov, Krasny prospekt, 56, kv. 59; Veniamin V. Kamensky, ulitsa Derzhavina, 19, kv. 70; Eduard P. Varnello, ulitsa Dzerzhinskogo, 3, kv. 19; Sergei K. Tupitsyn, ulitsa Zorge, 123, kv. 31; Boris V. Nazarov, ulitsa Meditsinskie kadry, 4, kv. 18, all of Novosibirsk, U.S.S.R.

[21] Appl. No.: 868,464

[22] Filed: Jan. 10, 1978

Related U.S. Application Data

[63] Continuation of Ser. No. 632,170, Nov. 14, 1075, abandoned.

[51] Int. Cl.[2] ..... E21B 1/06

[52] U.S. Cl. ..... 173/78; 173/78; 173/80; 173/110; 173/131; 175/99

[58] Field of Search ..... 175/99, 91, 106, 98; 173/73, 78, 80, 131, 132, 110; 61/23; 404/339, 340; 91/234

[56] References Cited

U.S. PATENT DOCUMENTS

| | | | |
|---|---|---|---|
| 913,928 | 3/1909 | Traylor | 173/110 |
| 1,654,833 | 1/1928 | Rice, Jr. | 173/110 |
| 2,887,989 | 5/1959 | Dulaney | 173/77 X |
| 3,978,931 | 9/1976 | Sudnishnikov | 175/99 |

*Primary Examiner*—William F. Pate, III

*Attorney, Agent, or Firm*—Haseltine, Lake & Waters

[57] ABSTRACT

The drill has a housing receiving therein a reciprocating striker, effecting percussive action upon the tool for breaking the rock at the face of the hole, mounted at the forward part of the housing, and upon the housing itself for propelling the drill in the hole. The housing also receives therein a mechanism for rotating the tool, including a self-controlled coupling provided with a movable sleeve and a stationary sleeve and adapted to transmit a torque to the tool in only one direction of rotation. The drill is provided with a device preventing a rearward motion of the housing and its rotation during a drilling operation. The drill is characterized by having a return device for retracting the tool from the face after it has been struck by the striker. The return device includes a piston mounted on the tail portion of the tool and mounted intermediate the striker and the forward bottom of the housing, a piston space defined between the piston and the forward bottom of the housing and a resilient member accommodated in this space and cooperating with the piston.

16 Claims, 10 Drawing Figures

AIR-OPERATED SELF-PROPELLING ROTARY-PERCUSSIVE DOWNHOLE DRILL

This is a continuation of application Ser. No. 632,170 filed Nov. 14, 1975 now abandoned.

FIELD OF THE INVENTION

The present invention relates to percussive drills and more particularly it relates to air-operated self-propelling downhole drills of a rotary-percussive action, employed for drilling boreholes in hard and very hard rock.

PRIOR ART

There is a known air-operated self-propelling rotary-percussive downhole drill for drilling boreholes in hard and very hard rock (see USSR Inventor's Certificate No 115,474, Int. Cl. E 21 c 3/04).

The known drill includes a housing accommodating therein a striking mechanism of which the striker is at the same time the tool of the drill, reciprocating through idle and working strokes under the action of compressed air and delivering impacts upon the rock to be broken. When the tool, as it is driven into the rock, advances into its foremost position, the striker-tool strikes the housing and thus propels the drill toward the face.

The known drill further includes a tool-rotating mechanism having a heliocoidally threaded couple and a self-controlled coupling, which in the described embodiment is a unidirectional freewheeling coupling, adapted to transmit a torque to the tool, as the striker reciprocates through the working and idle strokes, only in one direction of rotation. The tail or rear part of the housing has mounted thereon a device preventing a rearward motion and rotation of the drill in the course of a drilling operation. The device includes toothed plates pivoted to the tail of the housing and spring-urged to the wall of the hole. The drill is provided with means for air-blasting the face area and for removing the sludge from the hole.

The striker, being also the tool, its weight is bound to be relatively great, and, consequently, this fact decreases the frequency of strikes and speed that reduces the capacity of the drill and effect of breaking the rock.

Furthermore, with the striker being mounted between the two cylindrical walls of the housing, it may become jammed in the housing and in the hole, too, since the striker is also the tool. The striker may get jammed in the hole also on account of the rock cuttings accummulating in the annular gap between the housing and the striker.

SUMMARY OF THE INVENTION

It is an object of the present invention to provide a device for withdrawing the tool from the face upon its having struck the rock and thus to create an air-operated self-propelling rotary-percussive downhole drill, which should be capable of having greater capacity, whereby the energy taken from the moving striker will be reduced, and the resistance to the rotation of the tool in the hole will be likewise reduced.

This and other objects are attained in an air-operated self-propelling rotary-percussive downhole drill, having a housing accommodating therein a striking mechanism with a striker actuated by compressed air through working and idle reciprocatory strokes and effecting a percussive action upon the tool for breaking the rock of the hole face, mounted at the head part of the housing, and upon the housing itself for propelling the drill in the hole, a mechanism for rotating the tool, having a self-controlled coupling including a stationary sleeve and a movable one, adapted to transmit a torque to the tool only in one direction of rotation, the stationary sleeve being integral with the housing of the drill, means preventing a rearward motion of the housing and its rotation at drilling and means for air-blasting the face area and for removing the sludge from the borehole. In accordance with the invention, the drill is provided with a return device for withdrawing the tool from the face of the hole upon its having been struck by the striker.

It is expedient that the return device should include a piston mounted on the tail portion of the tool, intermediate the striker and the forward bottom of the housing, a piston space defined between the piston and the forward bottom or end wall of the housing and a resilient member accommodated in this space and cooperating with the piston.

In one embodiment of the invention the resilient member is in the form of a shock absorber or an air dashpot which may be formed by communication via a passage with a source of compressed air of the piston space.

The above features provide for reliable withdrawal of the tool from the face of the hole upon the tool having been struck by the striker, the latter being drivingly connected neither with the rotating mechanism nor with the tool itself. Furthermore, the above features provide for reducing the resistance to the rotation of the tool in the borehole and for delivering harder impacts upon the forward bottom of the housing of the drill.

It is further expedient that the return device should be drivingly connected with the tool rotating mechanism and with the tool itself by providing helicoidal threads on the external surface of the tail portion of the tool and on the internal portion of the movable sleeve of the unidirectional coupling, which thus forms a helicoidally threaded couple made by a helicoidally threaded stud and a helicoidal nut.

The abovedescribed driving connection of the return device with the tool rotating mechanism enabels to combine them into a unitary structure, which brings down the weight and overall dimensions of the drill and effects the rotation of the tool in combination with its withdrawal from the face of the hole, and also steps up the percussive capacity of the drill.

It is further expedient to preset the angle of the rotation of the tool at each operating cycle of the drill by providing tapering surfaces on the end face of the helicoidal nut, facing the striker, and on the housing of the drill, these surface ensuring that the nut and the housing make up a conical unidirectional friction coupling, and also to accommodate a locking means between the nut and the forward bottom of the housing, including a resilient member.

The above arrangement provides for presetting relatively accurately the angle of the rotation of the tool per each operating cycle of the drill.

It is likewise expedient that the end faces of the piston and of the movable sleeve of the unidirectional coupling mounted on the tail portion of the tool, facing each other, should be provided with profile lugs, the space acting as the air dashpot being defined between the housing of the drill and these end faces of the piston and of the movable sleeve of the unidirectional coupling, the driving connection between the return device, the tool rotating mechanism and the tool being effected by means of rods pivotally connected to these lugs of the piston and of the movable sleeve, so that with these end faces of the piston and of the movable sleeve directly contacting each other these rods should extend in a plane perpendicular to the longitudinal axis of the tool.

The last-described driving connection of the return device with the tool rotating mechanism and with the tool provides for increasing the initial torque effecting the rotation of the tool in the hole, as it is broken away off the face of the hole, as well as for reducing the angular speed of the rotating tool, which prevents jamming of the tool in the hole.

It is further expedient that the rods should include resilient members, which would step up the reliability of the performance of the return device and of the tool rotating mechanism incorporating the rods, and prolong their service life.

It is still further expedient that the housing of the drill should have an opening periodically communicating the space acting as the air dashpot with the ambient air, as the tool is moving away from the face of the hole, which amounts to a more flexible performance of the air dashpot in the piston space.

It is likewise expedient to mount a shock absorber on the tail portion of the tool, intermediate the housing of the drill and the head of the tool, and thus to dampen the impacts of the tool against the housing of the drill.

The present invention offers an air-operated self-propelling downhole drill for drilling boreholes in hard rock, with the sludge being removed from the face area, which features an increased percussive capacity and an improved reliability of the performance, as well as an increased value of the torque applied to the tool.

BRIEF DESCRIPTION OF THE DRAWINGS

The present invention will be further described in connections with embodiments thereof, with reference being made to the accompanying drawings, wherein.

DETAILED DESCRIPTION

Figure 1:
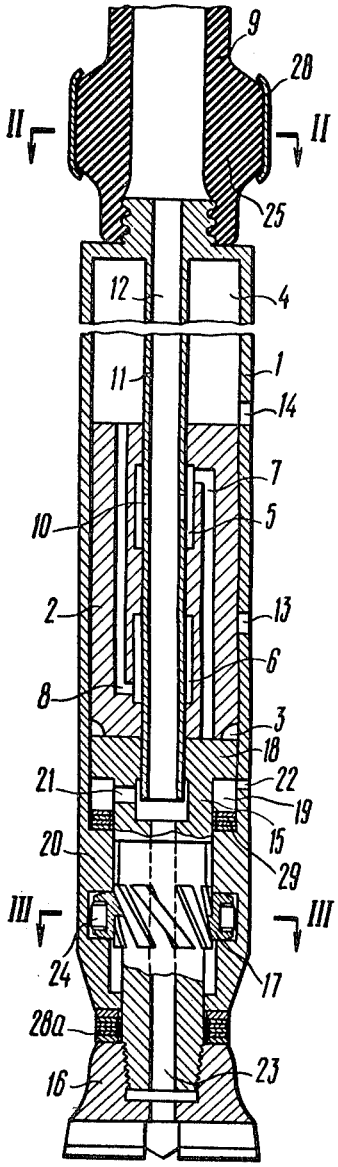
FIG. 1 is a longitudinal sectional view of an air-operated self-propelling rotary-percussive downhole drill in accordance with the invention.

Referring now to the drawings, the air-operated self-propelling rotary percussive downhole drill illustrated in FIGS. 1 to 10 is a self-propelling projectile incorporating several interacting and cooperating mechanisms accommodated with a single housing 1 (FIG. 1).

The major component of the drill is the air-operated striking mechanism of which the striker 2 is received inside the housing 1 and divides the housing 1 into a forward working space 3 and a rear one 4. The air control is effected by the striker 2 having for this purpose annular internal grooves 5 and 6 communicating via passages 7 and 8 in the body of the striker 2, respectively, with the forward working space 3 and with the rear one 4.

Compressed air is supplied in operation from a suitable source, e.g. from an air compressor (not shown) via an air supply hose 9 to the annular grooves 5 and 6 through an opening 10 in the wall of a pipe 11 secured to the upper portion of the housing 1. The pipe 11 has an internal bore 12 communicating continuously with the compressed air source via the hose 9. To exhaust spent air from the forward working space 3, the side wall of the housing has a port 13, while a port 14 is provided to exhaust spent air from the rear working space 4.

The forward part of the housing 1 accommodates therein a tool rotating mechanism structurally associated with the return device and with the tail portion 15 of the tool 16.

The tool rotating mechanism includes a helicoidally threaded coupling wherein the helicoidal stud or screw is the tail portion 15 of the tool 16, while the helicoidal nut acts, in addition to its major function, as the movable sleeve of a self-controlled free wheeling coupling effecting the transmission of a torque to the tool 16, as the striker 2 is driven through its working and idle strokes, only in one direction, i.e. a unidirectional coupling.

The return device which may have several structural modifications is incorporated to positively withdraw the tool 16 from the face of the hole, upon its having been struck by the striker 2. The device includes a piston 18 mounted within the housing 1 on the tail portion 15 of the tool 16 for longitudinal reciprocation and rotation in the housing 1, the tail portion 15 of the piston 16 also acting in this embodiment as the piston rod of this piston 18. Furthermore, the return device includes a piston space 19 defined by the piston 18, the wall of the housing 1, the side surface of the tail portion 15 of the tool 16 and the forward or front bottom of the housing 1. The return device further includes a passage 21 made in the upper part of the tail portion 15 of the tool 16 and an opening 22 made through the wall of the housing 1. The passage 21 establishes continuous communication between the annular piston space 19 with the source of compressed air, while the opening 22 periodically connects the space 19 with the ambient air, as the tool 16 is moving from the face of the hole.

The junctions between the piston 18 and of the tail portion 15 of the tool 16 and the housing 1, as well as the junction between the piston and the pipe 11 are such that in operation there is prevented any substantial bleeding of compressed air from the annular piston space 19 into the working space 3, and there is likewise prevented any substantial bleeding of compressed air into the ambient atmosphere, when the opening 22 is closed.

The tail portion 15 of the tool 16 has an axial passage 23 therein for supplying compressed air to the face of the hole, to air-blast the face area and to remove the sludge from the face. The passage 23 permanently communicates with the source of compressed air via the pipe 11.

The unidirectional freewheeling coupling is made up by the movable sleeve which is formed by the helicoidal nut 17, rollers 24 and a stationary external sleeve which in the presently described embodiment is integral with the housing 1.

To prevent a rearward motion of the drill in operation on account of its recoil, and also to prevent rotation of the drill about its longitudinal axis, the rear part of the housing 1 is connected with a braking device including an elastic tubular member 25 (FIG. 2) with lugs 26 on its external surface. In cross-section the elastic tubular member 25 has an oval-shaped bore 27 which permanently communicates with the source of compressed air through the hose 9, the greater-radi portions of the oval being adjacent to the lugs 26. The external peripheral surfaces of the lugs 26 have mounted thereon brake shoes 28 offering improved friction properties and resistance to a rubbing abrasive wear.

There is mounted intermediate the housing 1 and the head of the tool 16, on the tail portion 15 of the latter, a shock-adsorber **28*a***, e.g. in the form of a stack of annular metal plates.

Figure 2:
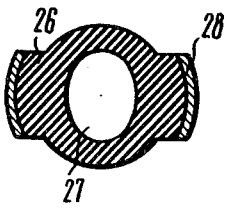
FIG. 2 is a sectional view taken on line II—II in FIG. 1.
Figure 3:
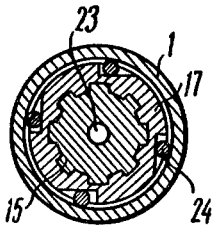
FIG. 3 is a sectional view taken on line III—III in FIG. 1.
Figure 4:
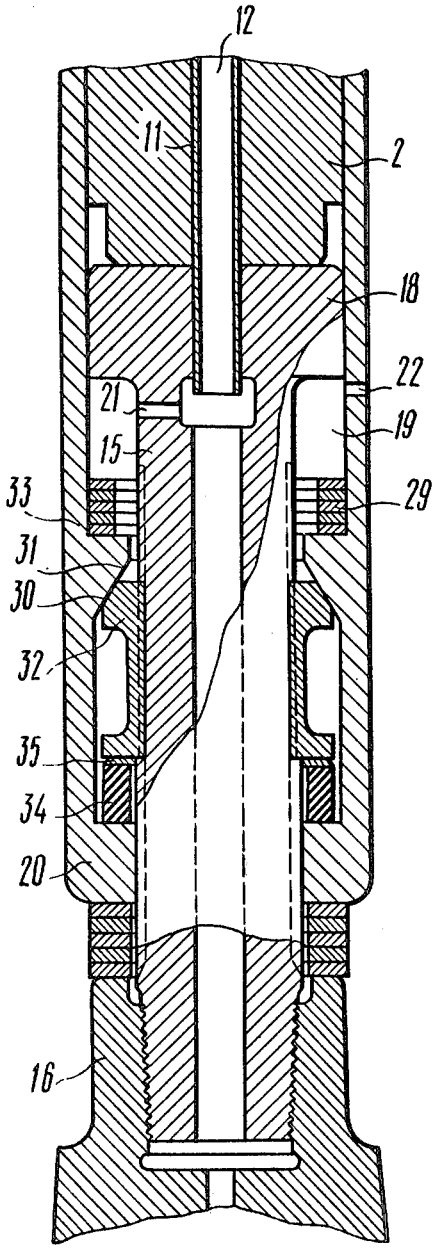
FIG. 4 illustrates a longitudinal sectional view of an embodiment of the return device incorporating a conical undirectional friction clutch.

The herein disclosed air-operated self-propelling rotary-percussive downhole drill, illustrated in FIGS. 1 to 3, operates, as follows.

With the air supply hose 9 (FIG. 1) connected to a source of compressed air, the compressed air enters the drill through the internal space 27 of the tubular member 25 and the passage 12 of the pipe 11. The pressure of the compressed air tends to expand the oval cross-section of the space 27 into a circular one, whereby the lugs 26 with the friction linings or shoes 28 thereon are urged against either the wall of a startup tube or the wall of a pre-bored hole. Thus, there is ensured friction between the shoes 28 and the wall of the hole, which retains the drill in the hole during its operation.

The compressed air also enters the working space 3 via the bore 10 of the pipe 11, the annular groove 5 and the passage 7 in the body of the striker, while the exhaust port 14 connects the working space 4 to the ambient atmosphere.

Simultaneously with commencing the air supply into the working space 3, compressed air is fed via the passage 12 of the pipe 11 and the passage 21 in the piston 18 into the annular space 19 wherein it acts on the surface of the piston 18, whereby the tool 16 is driven into its rearmost position.

The pressure differential in the working spaces 3 and 4 drives the striker 2 in a direction opposing that of the drilling, i.e. through an idle stroke. At the end of this idle stroke the annular groove 6 communicates with the bore 10 in the pipe 11, and compressed air enters the working space 4 via the passage 8. At the same time, the port 15 is open to exhaust the spent compressed air from the working space 3 into the ambient atmosphere, whereas the port 14 is closed by the striker 2.

Thus, there are created the conditions of driving the striker 2 through a working stroke.

The pressure differential in the working spaces 3 and 4 drives the striker 2 through a working stroke at the end of which the striker strikes the tail portion 15 of the tool 16 supporting the piston 18. The tool 16 is propelled against the rock to break the latter. During this motion of the tool 16 the movable sleeve 17 of the unidirectional coupling which is also the helicoidal nut, freely rotates and does not interfere with the axial motion of the tool 16 of which the tail portion 15 is also the helicoidal stud. The compressed air filling the annular space 19 is further compressed and partially forced via the passage 21 into the passage 23 by the piston 18 mounted on the tail portion 15 of the tool 16. This forcing of the compressed air from the annular space 19 takes place because the pressure in the last-mentioned space is at this moment higher than that in the passage 23, owing to the dynamic load being applied to the piston 18 at a high rate and to the volume of the space 19 thus rapidly decreasing.

As the striker 2 moves away from the tail portion 15 of the tool 16 with the piston 18, upon having struck this tail portion 15, the compressed air in the space 19 acts upon the surface of the piston 18, and this action in combination with the recoil of the tool 16 from the rock face reliably retracts the tool 16 from the face.

While exerting the percussive action upon the tail portion 15 of the tool 16 with the piston 18, the striker 2 simultaneously exerts a percussive action upon the housing 1 of the drill through the air dashpot in the space 19, and thus sends the drill forward in the drilling direction, overcoming the resistance of the friction between the wall of the borehole and the braking shoes 28 (FIG. 2) of the device preventing the rearward motion and rotation of the housing at drilling.

The movable sleeve 17 (FIG. 3) of the unidirectional coupling, which in the presently described embodiment is a free-wheeling coupling, also acting as the helicoidal unit, is wedged by the rollers 24 during the motion of the tool 16 away from the rock face, whereby the tool 16, with the sleeve 17 thus wedged, rotates in the latter through the preset angle. The tool 16 moves away from the rock face until it engages a stop provided for the purpose on the housing of the drill, e.g. the shock adsorber **28*a* (FIG. 1). With the tool 16 thus moving, the piston 18 supported thereon moves therewith, whereby the volume of the piston space 19 increases, and the pressure therein becomes equal to that in the passage 23. Now the tool 16 is prepared for being struck once again by the striker 2**. Then the abovedescribed operating cycle of the drill repeats itself.

In the modification where the opening 22 (FIG. 1) is made in the housing 1 to connect the space 19 periodically to the ambient atmosphere, the operation of the return device is basically similar to the operation described hereinabove. With the tail portion 15 of the tool 16 in the rearmost (relative to the face of the borehole) position, the opening 22 connects the space 19 with the atmosphere, whereby a portion of the compressed air exits from the space 19 and takes part in carrying the rock fragments away from the face of the borehole. As the piston 18 moves jointly with the tool 16 towards the face, the opening 22 becomes closed by the side surface of the piston 18, whereby the pressure is built up in the space 19. However, this slightly modified operation of the return device reduces the losses of the impact energy of the striker 2 on account of the necessity to compress the relatively "rigid" air dashpot in the space 19, produced on account of the clearances between the side surface of the piston 18 and the wall of the housing 1 being relatively small, and the pressure of compressed air coming from the source being relatively high.

When a shock absorber 29 (FIG. 1) is mounted in the space 19, e.g. in the form of a stack of annular metal plates, the operation of the drill, including that of the return device does not vary. The provision of the shock adsorber 29 merely prevents hard impacts of the piston against the housing of the drill, should the air dashpot in the space 19 prove insufficient "rigid".

Figure 5:
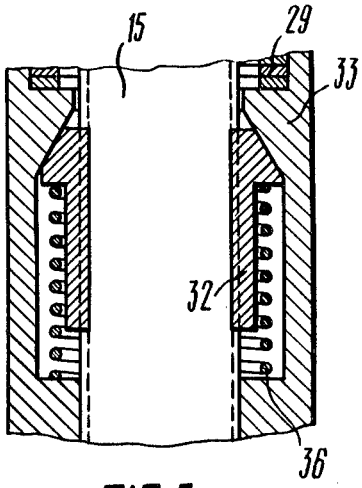
FIG. 5 is a longitudinal sectional view of the locking arrangement cooperable with the return device illustrated in FIG. 4.
Figure 6:
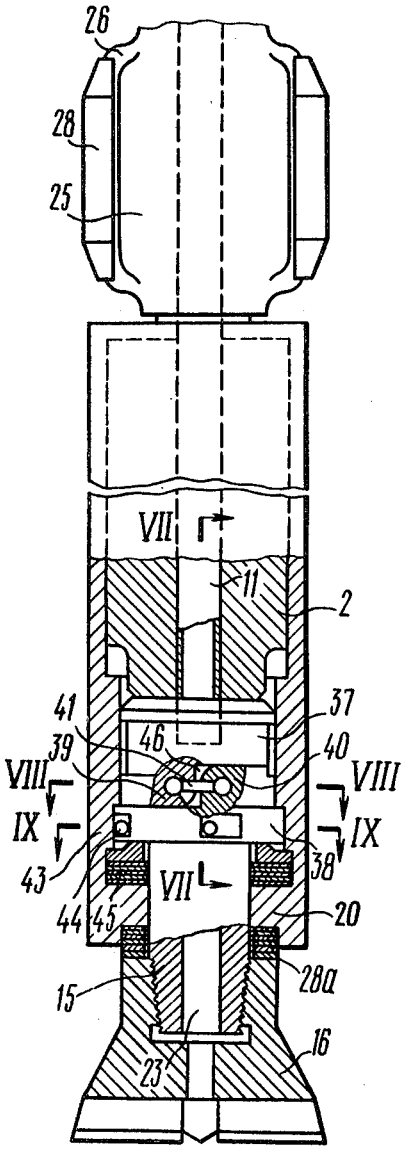
FIG. 6 is a longitudinal sectional view of the return device wherein the tool rotating mechanism incorporates the rods.
Figure 7:
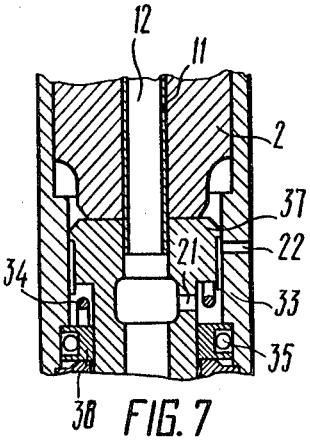
FIG. 7 is a sectional view taken on line VII—VII in FIG. 6.
Figure 8:
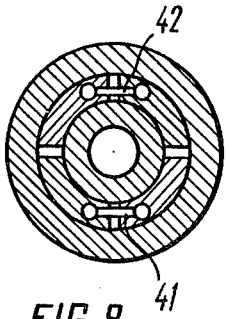
FIG. 8 is a sectional view taken on line VIII—VIII in FIG. 6.
Figure 9:
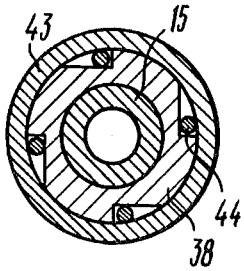
FIG. 9 is a sectional view taken on line IX—IX in FIG. 6.

Should it be necessary to ensure a precise angle of rotation of the tool per each operating cycle of the drill, which the unidirectional self-controlled freewheeling coupling is not always capable of ensuring, it is expedient to use a self-controlled conical friction coupling with dynamic locking and unlocking of its half-couplings. To attain this, the tool rotating mechanism described in connection with FIGS. 1 to 3, structurally combined with the return device, has the end face of the movable sleeve 17 (which is also the helicoidal nut), facing the striker 2, and the housing 1 of the drill provided with matching tapering surfaces 30 and 31 by means of which the movable sleeve 32 (FIG. 4) of the coupling and the housing 33 make up a self-controlled conical friction coupling with dynamic locking and unlocking of its half-couplings. To ensure the normal operation of this coupling, there is mounted intermediate the movable sleeve 32 thereof and the forward bottom 20 of the housing 33 a locking device including a shock absorber in the form of an elastic ring 34 with a gasket 35. Alternatively, the shock absorber may be in the form of a compression spring 36 (FIG. 5).

The operation of the return device combined with the rotating mechanism and the tool, according to the last-described modification, is, as follows. As the striker 2 (of which the motion in the housing 1 has been described hereinabove in connection with the drawings, FIGS. 1 to 3) strikes the tail portion 15 of the tool 16, the latter is propelled toward the rock face to penetrate and break the rock. As the striker 2 thus strikes the tail portion 15 of the tool 16, the engagement between the conical surface 31 of the housing 33 and the conical surface 30 of the movable sleeve 32 of the friction coupling is broken. As the inertia of the movable sleeve 32 of the coupling is but a fraction of that of the tool 16 with the piston 18, the movable sleeve 32 is bound to rotate about the axis of the axially moving tool 16. As the striker 2 moves through its return or idle stroke, its rearward motion is followed by the tool 16 with the piston 18, on account of the recoil of the tool from the rock face and the action of the compressed air in the space 19 upon the piston. This brings about the engagement of the conical surface 31 of the housing 33 with the conical surface 30 of the movable sleeve 32 under the action of the resilience of the pre-compressed shock absorber 34 (or else of the pre-compressed spring 36—see FIG. 5). With the conical friction coupling locked, the tool 16 is positively rotated through the angle preset per one operating cycle of the drill, the sleeve 32 now being stationary and fast with the housing 33.

Owing to the last-described locking of the coupling, the tool will be rotated through the same angle in the same direction at every successive cycle of the operation.

As the piston 18 approaches its rearmost position relative to the rock face, immediately preceding its impact against the striker 2, the exhaust opening 22 opens, and the compressed air from the space 19 exits into the ambient atmosphere. By this time the tool 16 is ready to receive the successive impact from the striker 2. Then the abovedescribed operating cycle of the last-mentioned modification of the return device combined with the tool rotating mechanism and the tool repeates itself.

There is illustrated in FIGS. 6 to 9 of the appended drawings another embodiment of the return device combined with the tool rotating mechanism and the tool itself. The characteristic feature of this embodiment of the return device is that the end faces of the piston 37 (FIG. 6) and of the movable sleeve of the self-controlled freewheeling coupling, facing each other, have made thereon, respectively, profile lugs 39 and 40 by means of which the piston 37 and the movable sleeve 38 are pivotally connected with each other with aid of rods 41 and 42. With the end faces of the piston 37 and of the movable sleeve 58 directly engaging each other, the rods 41 and 42 extend in a plane perpendicular to the longitudinal axis of the tool. Since in this case the movable sleeve 38 of the self-controlled freewheeling coupling, as it has been already described, both rotates about its axis and moves along this axis at the corresponding stage of the operating cycle, there are mounted between the housing 43 and the sleeve 38 a plurality of balls 44 instead of the rollers of the previously described embodiment, there being mounted intermediate the sleeve 38 and the forward bottom 20 of the housing 43 a shock absorber 45 similar to the shock absorber 29 described hereinabove in connection with FIG. 1. In this embodiment the movable sleeve 38 permits axial displacement of the tail portion 15 of the tool 16, coaxially extending in the sleeve 38. Unlike the previously described embodiments of the herein disclosed drill, in the presently described embodiment the space 46 acting as the air dashpot is defined by the end faces of the sleeve 38 and of the piston 37 and by the internal wall of the housing 43.

The return device combined with the tool rotating mechanism, according to the last-described embodiment, operates, as follows.

As compressed air is supplied into the drill described hereinabove in connection with FIGS. 1 to 3, the air flows through the bore 12 of the pipe 11 and through the passage 21 in the tail portion 15 of the tool 16 into the space 46 (FIG. 6) and thus creates the dashpot. Under the action of the pressure of the compressed air in the space 46 the piston 37 is driven toward the striker 2, the movable sleeve 38 of the coupling, which is capable of rotating about the axis of the drill only in one direction, remaining stationary, and the tool 16 with the piston 18 carried thereby rotating about its axis. The tool 16 keeps rotating until it reaches the rearmost position relative to the rock face, by engaging the means limiting its rearward stroke, e.g. the shock absorber 28*a*. The tool 16 then remains in this position until struck by the striker 2. When the striker 2 strikes the tail portion 15 of the tool 16 with the piston 18, the tool is propelled against the face to penetrate and break the rock, while the sleeve 38 of the freewheeling coupling rotates, since its inertia is but a fragemnt of that of the tool 16. The abovedescribed cycle then repeats itself.

With the rods 41 and 42 extending in the plane perpendicular to the axis of the tool 16 (this position being shown in FIG. 6), the conditions of rotating the tool are optimal, since then the torque applied to the tool 16 is at the maximum, and with the tool 16 being driven off the rock face, its speed of rotation is at the minimum.

Figure 10:
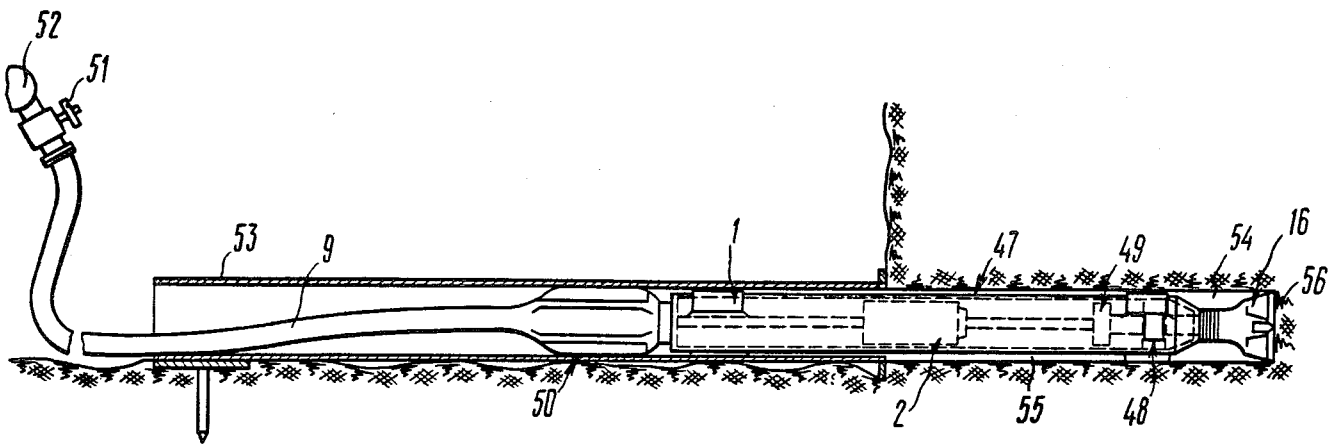
FIG. 10 is a general view of an air-operated self-propelling rotary-percussive downhole drill, according to the invention in the operational position of the drill.

FIG. 10 of the appended drawings illustrates the air-operated downhole drill 47 of the rotary-percussive action in operation.

The drill 47 includes the striker 2, a tool rotating mechanism 48 which is not drivingly connected with a return device 49 serving to withdraw the tool 16 from the rock face, a device 50 opposing a rearward motion and rotation of the housing during the drilling operation, mounted at the tail part of the housing 1 of the drill, an air hose 9 for the supply of compressed air to the drill, connecting the latter via a valve 51 to the compressed air source 52.

Prior to starting the drill, it is accommodated in a startup device, e.g. in a hollow tube 53 of which the internal diameter equals that of the hole 54 to be drilled.

The annular space 55 between the housing of the drill and the hole or the internal wall of the tube 53 serves as a channel through which the rock fragments and like products of drilling are removed from the rock face 56.

The drill is operated in the following sequence. The valve 51 is opened to establish communication between the source 52 of compressed air and the hose 9 via which compressed air passes through the device 50, making the latter operative with out delay.

The air also enters one of the working spaces of the drill and the space under the piston of the return device 49, the air being also fed to blast the rock face.

Under the action of compressed air in the working spaces the striker 2 reciprocates, striking repeatedly the tail portion of the tool 16 and also striking the housing 1 of the drill either through the air dashpot or through the shock absorber. Consequently, the housing 1 of the drill, while receiving the impacts of the striker 2, overcomes the friction between the device 50 and the wall of the borehole and moves toward the face, following the progress of the tool 16.

Upon the tool 16 having been struck by the striker 2, the return device 49 withdraws the tool 16 from the rock face 56. The return device 49 being combined with the tool rotating mechanism, the tool simultaneously retracts from the rock face and rotates through the preset angle about its axis.

The herein disclosed arrangement precludes jamming of the tool in the hole, steps up the reliability of th performance of the drill and the service life of the tool.

The flow of the compressed air carries the sludge, i.e. the rock fragments and the like, up the hole and away from the hole via the annular space 55.

To retract the drill 47 from the borehole, either one of the known techniques of surfacing drills of this kind can be resorted to. Thus, it is possible to use a rope secured to the tail part of the housing 1 and pulled from the surface. Another way is to in-build any suitable known reversing device of the kinds commonly employed with the drills of this kind within the housing 1 of the drill, preferably in the tail part thereof.

What is claimed is:

1. An air-operated self-propelling rotary-percussive downhole drill for drilling boreholes, comprising: a housing having a head portion and a tail portion; a tool mounted in the head portion of said housing, said housing accommodating therein a striking mechanism with a striker actuated by compressed air through working and idle reciprocatory strokes, to effect a percussive action upon said tool for breaking rock at the hole face and upon said housing of the drill to propel said drill in the hole; means for rotating said tool including a self-controlled coupling having a stationary sleeve and a movable sleeve and means for transmitting a torque to said tool in only one direction of rotation, said stationary sleeve being integral with said housing of said drill; return means accommodated in the forward part of said housing of said drill for withdrawing said tool from the face after it has been struck by said striker, said return means being integral with the tail of the working tool and comprising a piston defining a chamber between the piston and the front wall of the housing, means providing constant communication between said chamber and a source of compressed air and periodic communication with the atmosphere through an opening provided in the housing; means arranged adjacent to the tail part of said housing of the drill and connected therewith, for preventing a rearward motion of the housing and its rotation during a drilling operation, the latter said means being constituted as a resilient tubular member; and means for air-blasting the face area and for removing sludge from the hole.

2. An air-operated self-propelling rotary-percussive downhole drill, comprising: a housing with bottoms, a tool mounted at the head portion of said housing, said housing accommodating therein a striking mechanism with a striker adapted to be actuated by compressed air to effect a percussive action upon said tool for breaking the rock at the hole face and upon said housing to propel said drill in the hole; means for rotating said tool, including a self-controlled coupling having a stationary sleeve and a movable sleeve and adapted to transmit a torque to said tool only in one direction of rotation, said stationary sleeve being integral with said housing of said drill; a return device for withdrawing said tool from the face, after it has been struck by said striker, having a piston mounted on the tail portion of said tool, intermediate said striker and the forward bottom of said housing of said drill, a piston space defined between said piston and the forward bottom of said housing, a resilient member accommodated in said piston space and cooperating with said piston; means mounted adjacent to the rear part of said housing of said drill and connected therewith, adapted to prevent a rearward motion and rotation of said housing during a drilling operation; means for air-blasting the face area and for removing the sludge from the hole.

3. An air-operated drill as set forth in claim 1, comprising a resilient member accommodated in said piston chamber constituted as a shock absorber.

4. An air-operated drill as set forth in claim 1, wherein said piston of the return means has a passage communicating said piston chamber with the source of compressed air, whereby said space acts as an air dashpot.

5. An air-operated self-propelling rotary-percussive downhole drill, comprising a housing with a head section, a tail portion and a bottom, a tool mounted at the head portion of said housing, having an external helicoidal thread on the tail portion thereof; said housing accomodating a striking mechanism with a striker adapted to be actuated by compressed air through working and idle reciprocatory strokes and to effect a percussive action upon said tool to break rock at the face of the hole and upon said housing of said drill to propel said drill in the hole; return means for withdrawing said tool from the face upon its having been struck by said striker, including a piston mounted on the tail portion of said tool, intermediate said striker and the bottom of said housing of said drill, a piston space defined between said piston and the forward bottom of said housing; a resilient member accommodated in said piston space and cooperating with said piston; means for rotating said tool, including a coupling adapted to transmit a torque to said tool only in one direction of rotation, said coupling having a stationary sleeve and a movable sleeve, said movable sleeve having an internal helicoidal thread and forming a helicoidally threaded coupling with the tail portion of said tool, the latter having an external helicoidal thread and acting as the rod of said piston of said return device, said helicoidally threaded coupling effecting the driving connection of said return device with said tool rotating mechanism and said tool, the stationary sleeve of said coupling being integral with said housing of said drill; means positioned adjacent to the rear part of said housing of the drill and connected therewith, for preventing rearward motion and rotation of said housing during a drilling operation; and means for airblasting the face area and for removing sludge from the hole.

6. An air-operated drill as set forth in claim 5, wherein said resilient member accommodated in said piston space is a shock absorber.

7. An air-operated drill as set forth in claim 5, wherein said piston of the return device has a passage communicating said piston space of the return device with a source of compressed air, whereby said piston space acts as an air dashpot.

8. An air-operated drill as set forth in claim 5, wherein, in order to improve the conditions of prefixing the angle of rotation of said tool per each operating cycle of the drill, the end face of said helicoidal nut, facing said striker, and said housing of the drill have conical surfaces thereon by means of which said nut and said housing make up a conical friction coupling, a locking device being provided between said nut and the forward bottom of said housing.

9. An air-operated drill as set forth in claim 8, wherein said locking device is a resilient member.

10. An air-operated self-propelled rotary-percussive downhole drill for drilling boreholes, comprising a housing having a head part, a tail part and a bottom; a tool mounted the heat part of said housing; said drill accommodating therein: a striking mechanism with a striker adapted to be actuated by compressed air through working and idle reciprocatory strokes, to effect percussive action upon said tool to break rock at the face of the hole and upon said housing of said drill to propel said drill in the hole; return means for withdrawing said tool from the face upon its having been struck by said striker, comprising a piston mounted on the tail portion of said tool, intermediate said striker and the bottom of said housing, a piston space defined between said piston and the forward bottom of said housing, a resilient member accommodated in said piston space and cooperating with said piston; a mechanism for rotating said tool, including a coupling having a stationary sleeve and a movable sleeve and adapted to transmit a torque to said tool only in one direction of rotation, said stationary sleeve being integral with said housing of said drill; said tool rotating mechanism further including profiled lugs on the opposing end faces of said piston of said return device and of said movable sleeve of said self-controlled coupling, mounted on the tail portion of said tool, said profiled lugs receiving therebetween rods pivotally connected therewith, said rods effecting a driving connection between said return device, said tool rotating mechanism and said tool; so that with the end faces of said piston and said movable sleeve directly engaging each other, said rods extend in a plane perpendicular to the longitudinal axis of said tool, said piston space accommodating said resilient member being defined by said housing of said drill and said end faces, respectively, of said piston of said return device and said movable sleeve of said self-controlled coupling; means positioned adjacent to the rear part of said housing of said drill and connected therewith, for preventing rearward motion and rotation of said housing during a drilling operation; and means for air-blasting the face area and for removing sludge from the hole.

11. An air-operated drill as set forth in claim 10, wherein said rods are in the form of resilient members.

12. An air-operated drill as set forth in claim 10, wherein said housing of the drill has made an opening adapted to connect periodically said piston space of the return device with the ambient atmosphere, as said tool is moving away from the rock face.

13. An air-operated drill as set forth in claim 10, wherein the tail portion of said tool has mounted thereon a shock absorber accommodated between said housing of the drill and the working head of said tool.

14. An air-operated self-propelled rotary percussive downhole drill for drilling boreholes, comprising a housing having a head portion and a rear portion, a drill bit mounted in the head portion of said housing, a striking mechanism in said housing including a striker actuated by compressed air through idle and working reciprocating strokes to subject said drill bit and housing to percussive action to advance said drill in the hole; means for rotating said drill bit including a self-controlled coupling comprising a movable sleeve and a stationary sleeve adapted to transmit a torque to said drill bit in only one direction of rotation; means disposed adjacent and associated with the rear portion of said drill housing to preclude rearward motion of said housing during a drilling operation; means to air-blast the face area and remove the sludge from the hole; return means mounted in the front portion of the cylinder of said housing and defined by a piston mechanism, the piston of which is integral with the drill bit shank to define in conjunction with the front bottom and cylindrical wall of said housing a piston working space, and means providing constant communication between said space and a source of compressed air.

15. An air-operated drill as claimed in claim 14, wherein the piston of the return means comprises two discs of which one acts as the movable sleeve of said self-controlled coupling; projecting portions on opposed end faces of said discs, links hinged to said projecting portions disposed therebetween to operatively connect said return means and drill bit rotating means; in case of direct contact between the end faces of the discs said links are disposed in a plane normal to the center-line of said drill bit, at which time the piston discs define therebetween the working space of the return means.

16. An air operated drill as claimed in claim 14, wherein the end face of the movable sleeve of the self-controlled coupling, which faces said striker, and said drill housing have tapering surfaces whereby said movable sleeve of the coupling defines a self-controlled tapering friction coupling, and a locking device between said sleeve and the front bottom of said drill housing, whereby the conditions of prefixing the angle of rotation of said drill bit in each of the operating cycles of said drill is improved.

* * * * *